US011550251B2

(12) United States Patent
Nakaiwa et al.

(10) Patent No.: US 11,550,251 B2
(45) Date of Patent: Jan. 10, 2023

(54) IMAGE FORMING APPARATUS

(71) Applicant: KYOCERA Document Solutions Inc., Osaka (JP)

(72) Inventors: Yuki Nakaiwa, Osaka (JP); Masaru Watanabe, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/510,631

(22) Filed: Oct. 26, 2021

(65) Prior Publication Data

US 2022/0137541 A1 May 5, 2022

(30) Foreign Application Priority Data

Oct. 29, 2020 (JP) ..... JP2020-181156

(51) Int. Cl.
*G03G 15/00* (2006.01)
*G03G 15/043* (2006.01)

(52) U.S. Cl.
CPC ..... *G03G 15/5025* (2013.01); *G03G 15/043* (2013.01); *G03G 15/5058* (2013.01)

(58) Field of Classification Search
CPC ..... G03G 15/5025; G03G 15/5058; G03G 15/55; G03G 15/556
See application file for complete search history.

(56) References Cited

U.S. PATENT DOCUMENTS

2016/0085197 A1* 3/2016 Akita ..... G03G 15/556 399/27
2020/0285172 A1* 9/2020 Watanabe ..... G03G 15/0856
2020/0285185 A1* 9/2020 Watanabe ..... G03G 15/5062
2020/0285186 A1* 9/2020 Watanabe ..... G03G 15/5037

FOREIGN PATENT DOCUMENTS

JP 2008-292920 12/2008

* cited by examiner

*Primary Examiner* — Carla J Therrien
(74) *Attorney, Agent, or Firm* — Lex IP Meister, PLLC

(57) ABSTRACT

An image forming apparatus forms a coverage rate adjustment patch having a coverage rate corresponding to a difference between a coverage rate measured by a coverage rate measurement unit and a coverage rate of an adjustment image pattern together with an adjustment image pattern by using the exposure device and the developing device in the calibration.

4 Claims, 4 Drawing Sheets

| | COVERAGE RATE OF IMMEDIATELY PRECEDING PRINT SHEET (%) | | | | | COVERAGE RATE OF COVERAGE RATE ADJUSTMENT PATCH (%) | | | |
|---|---|---|---|---|---|---|---|---|---|
| | C | M | Y | K | | C | M | Y | K |
| EXAMPLE 1 | 15 | 5 | 3 | 5 | ⇨ | 14 | 4 | 2 | 4 |
| EXAMPLE 2 | 20 | 1 | 0 | 20 | ⇨ | 19 | 0 | 0 | 19 |

FIG. 4

| | COVERAGE RATE OF IMMEDIATELY PRECEDING PRINT SHEET (%) | | | | | COVERAGE RATE OF COVERAGE RATE ADJUSTMENT PATCH (%) | | | |
|---|---|---|---|---|---|---|---|---|---|
| | C | M | Y | K | | C | M | Y | K |
| EXAMPLE 1 | 15 | 5 | 3 | 5 | ⇧ | 14 | 4 | 2 | 4 |
| EXAMPLE 2 | 20 | 1 | 0 | 20 | ⇧ | 19 | 0 | 0 | 19 |

IMAGE FORMING APPARATUS

INCORPORATION BY REFERENCE

This application is based upon and claims the benefit of priority from the corresponding Japanese Patent Application No. 2020-181156 filed on Oct. 29, 2020, the entire contents of which are incorporated herein by reference.

BACKGROUND

The present disclosure relates to an image forming apparatus.

In general, an electrophotographic image forming apparatus performs calibration at a predetermined timing and adjusts engine output conditions (developing bias, exposure light amount, and the like), a gamma curve for gradation adjustment, and the like so that an image density characteristic of a print becomes a target density characteristic.

In the calibration, a predetermined image pattern (patch group) is formed on the intermediate transfer belt. The density of the image pattern is optically measured, and the above-described density characteristic (distribution of a plurality of gradation levels) is adjusted based on the measurement result.

The coverage rate of an image designated and printed by a user (hereinafter referred to as a user print image) is not fixed because it depends on the image. However, the coverage rate of an image pattern used for calibration (hereinafter referred to as a calibration image pattern) is fixed because it is a fixed image.

On the other hand, when the toner supplied from the developing device to the photosensitive drum fluctuates depending on the coverage rate, the toner charge amount temporarily fluctuates accordingly, and thus the developing characteristics (density characteristics of a toner image to be developed) temporarily fluctuate.

Therefore, when the coverage rate of the user print image immediately before calibration is different from the coverage rate of the calibration image pattern, there is a possibility that the calibration image pattern is formed with a development characteristic different from the development characteristic at the time of printing the user print image and that the above-described density adjustment is not accurately performed.

For example, in a case where the coverage rate of the immediately preceding user print image is higher than the coverage rate of the calibration image pattern, the toner charge amount is low at the start of calibration, and the toner charge amount gradually increases during execution of calibration. For this reason, the development characteristics change during development of the calibration image pattern, and the density adjustment described above is not accurately performed.

SUMMARY

An image forming apparatus according to this disclosure includes a photosensitive drum, an exposure device, a developing device, a calibration execution unit, and a coverage rate measurement unit. The exposure device irradiates the photosensitive drum with light to form an electrostatic latent image. The developing device performs development by causing toner to adhere to the electrostatic latent image. The calibration execution unit forms an adjustment image pattern by using the exposure device and the developing device, measures the density of the adjustment image pattern by using an optical sensor, and executes image density adjustment based on the measured density, in calibration. The coverage rate measurement unit measures coverage rate of the print image. The calibration execution unit forms a coverage rate adjustment patch having a coverage rate corresponding to a difference between a coverage rate measured by the coverage rate measurement unit and a coverage rate of the adjustment image pattern together with the adjustment image pattern by using the exposure device and the developing device in the calibration.

BRIEF DESCRIPTION OF THE DRAWINGS

FIG. 4 is a diagram showing an example of a coverage rate of the coverage rate adjustment patch in FIG. 3.

DETAILED DESCRIPTION

Hereinafter, embodiments of the present disclosure will be described with reference to the drawings.

Figure 1:
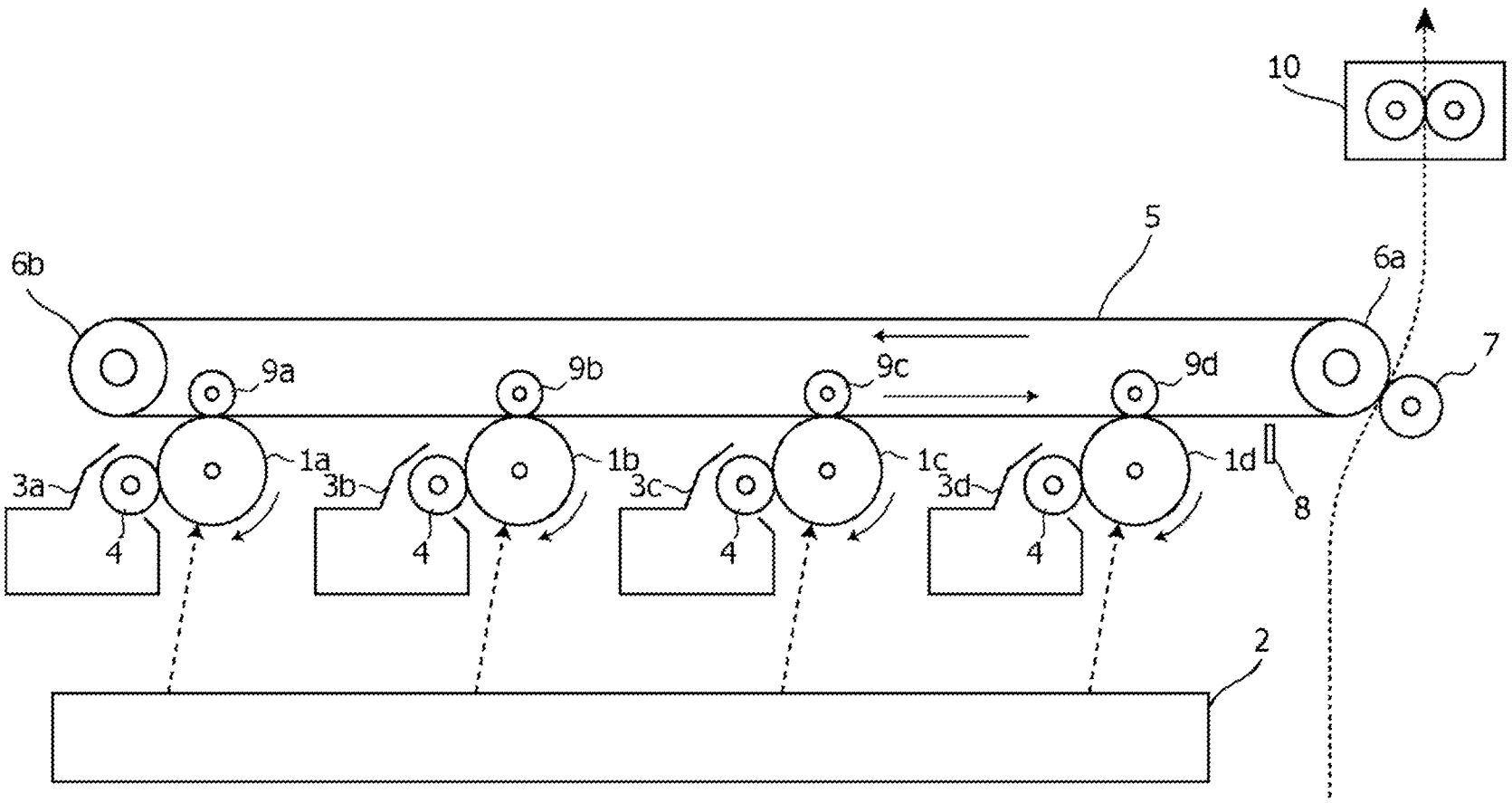
FIG. 1 is a side view showing a mechanical internal configuration of an image forming apparatus according to an embodiment of the present disclosure.

FIG. 1 is a side view showing a mechanical internal configuration of an image forming apparatus according to an embodiment of the present disclosure. The image forming apparatus illustrated in FIG. 1 is an apparatus having an electrophotographic printing function, such as a printer, a facsimile apparatus, a copying machine, or a multifunction peripheral.

The image forming apparatus of this embodiment has a tandem color developing device. The color developing device includes a photosensitive drum 1*a* to 1*d*, an exposure device 2, and a developing device 3*a* to 3*d*. The photosensitive drum 1*a* to 1*d* are photosensitive members of four colors of cyan, magenta, yellow, and black, and electrostatic latent images are formed on the photosensitive drum 1*a* to 1*d*. The exposure device 2 is a device that forms electrostatic latent images on the photosensitive drum 1*a* to 1*d* by irradiating the photosensitive drum 1*a* to 1*d* with light (here, laser light). The exposure device 2 includes a laser diode serving as a light source of laser light and an optical element (a lens, a mirror, a polygon mirror, or the like) that guides the laser light to the photosensitive drum 1*a* to 1*d*. The photosensitive drum 1*a* to 1*d* may be made of amorphous silicon or an organic photosensitive member (OPC).

The developing device 3*a* to 3*d* performs development by causing toner in a toner cartridge to adhere to electrostatic latent images on the photosensitive drum 1*a* to 1*d* by a developing roller 4, thereby forming toner images. Magenta development is performed by the photosensitive drum 1*a* and the developing device 3*a*, cyan development is performed by the photosensitive drum 1*b* and the developing device 3*b*, yellow development is performed by the photosensitive drum 1*c* and the developing device 3*c*, and black development is performed by the photosensitive drum 1*d* and the developing device 3*d*.

The intermediate transfer belt 5 is an annular image carrier that comes into contact with the photosensitive drum 1*a* to 1*d* and that carries the toner image on the photosensitive drum 1*a* to 1*d* transferred on the intermediate transfer belt 5. The intermediate transfer belt 5 is stretched around a driving roller 6*a* and a tension roller 6*b*, and is rotatably moved by a driving force from the driving roller 6*a* in a direction from a contact position with the photosensitive drum 1*a* to a contact position with the photosensitive drum 1*d*.

The secondary transfer roller 7 brings a conveyed print sheet (print paper or the like) into contact with the intermediate transfer belt 5, and secondarily transfers the toner image on the intermediate transfer belt 5 to the print sheet. The print sheet onto which the toner image has been secondarily transferred is conveyed to a fixing device 10. The fixing device 10 includes a heater, and fixes the toner image to the print sheet by a heating and pressing method using the heater.

The density sensor 8 is a reflective optical sensor that emits light to the intermediate transfer belt 5, receives reflected light (for example, regular reflected light and diffuse reflected light), and outputs an electric signal corresponding to the amount of the received reflected light. After a calibration toner image (such as an adjustment image pattern described later) is primarily transferred to the intermediate transfer belt 5, the density sensor 8 optically detects the density of the toner image on the intermediate transfer belt 5.

For example, in the calibration, the density sensor 8 measures the density of the adjustment image pattern (toner image) passing through the arrangement position of the density sensor 8. Specifically, the density sensor 8 emits light to a predetermined measurement region and receives the reflected light, and thus measures the density of the adjustment image pattern passing through the measurement region.

Each of the primary transfer rollers 9*a* to 9*d* is disposed to face the photosensitive drum 1*a* to 1*d* with the intermediate transfer belt 5 interposed therebetween, and primarily transfers the toner image on the photosensitive drum 1*a* to 1*d* from the photosensitive drum 1*a* to 1*d* to the intermediate transfer belt 5.

Figure 2:
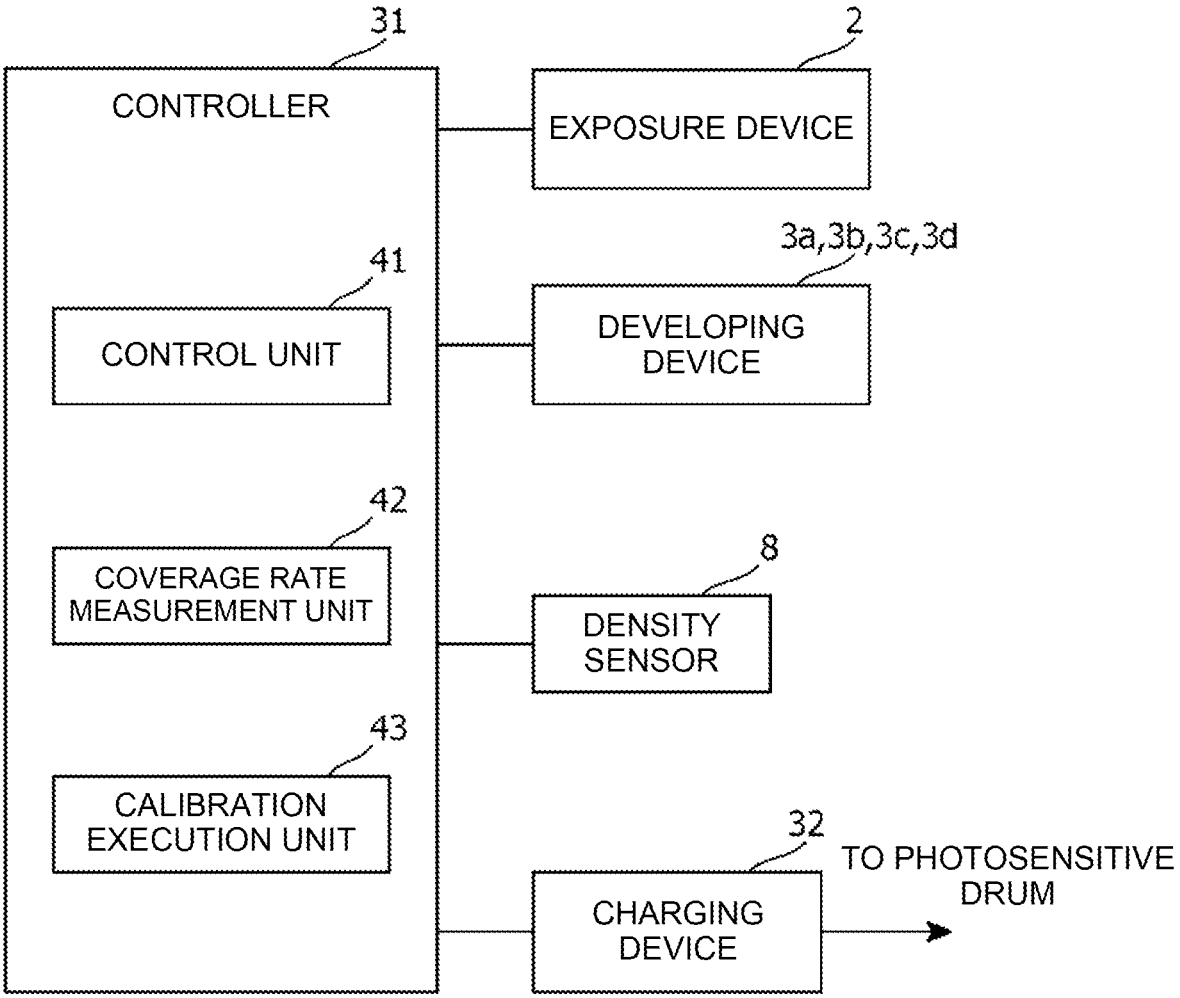
FIG. 2 is a block diagram showing a part of an electrical configuration of the image forming apparatus shown in FIG. 1.

FIG. 2 is a block diagram showing a part of an electrical configuration of the image forming apparatus shown in FIG. 1. As shown in FIG. 2, the image forming apparatus shown in FIG. 1 further includes a controller 31 and a charging device 32.

The controller 31 electrically controls each unit in the image forming apparatus. The controller 31 includes a microcomputer, an application specific integrated circuit (ASIC), or the like, and operates as various processing units that perform one or both of hardware processing and software processing.

The charging device 32 charges the surface of the photosensitive drum 1*a* to 1*d* to a predetermined potential (dark potential) or sets the surface potential of the photosensitive drum 1*a* to 1*d* to 0 volts (ground level).

The controller 31 operates as a control unit 41, a coverage rate measurement unit 42, and a calibration execution unit 43.

The control unit 41 performs predetermined image processing (gradation adjustment using a gamma curve, halftoning, and the like) on a target image designated by a user, controls the mechanical configuration (the photosensitive drum 1*a* to 1*d*, the exposure device 2, the developing device 3*a* to 3*d*, and the like) illustrated in FIG. 1, and executes printing of the target image after the image processing.

The coverage rate measurement unit 42 measures a coverage rate of a print image of the print executed by the control unit 41. Here, the coverage rate measurement unit 42 measures the coverage rates of the print images for a plurality of toner colors (cyan, magenta, yellow, and black), respectively. For example, the coverage rate measurement unit 42 derives the coverage rate by an existing method based on the number of dots in each toner color plane in the target image after the image processing.

The calibration execution unit 43 executes calibration at a predetermined timing, forms an adjustment image pattern using the exposure device 2 and the developing device 3*a* to 3*d* in the calibration, measures the density of the adjustment image pattern using the density sensor 8 (optical sensor), and executes image density adjustment based on the measured density. In the image density adjustment, an engine output condition, a gamma curve for gradation adjustment, and the like are adjusted so that density characteristics including gradation characteristics become target characteristics.

Figure 3:
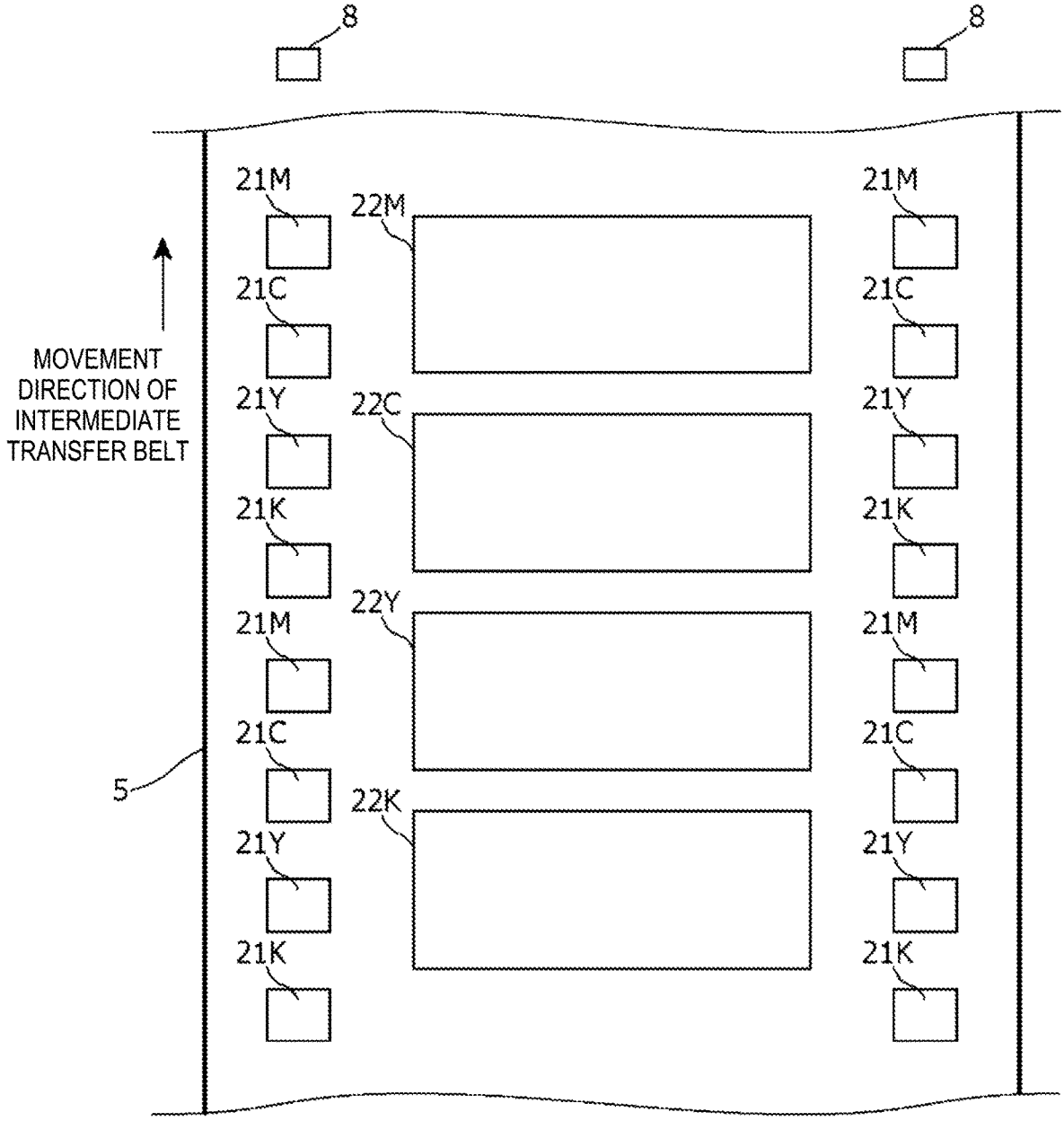
FIG. 3 is a diagram showing an example of an adjustment image pattern and a coverage rate adjustment patch formed at the time of calibration in the image forming apparatus shown in FIGS. 1 and 2.

FIG. 3 is a diagram showing an example of an adjustment image pattern and a coverage rate adjustment patch formed at the time of calibration in the image forming apparatus shown in FIGS. 1 and 2.

Further, as shown in FIG. 3, for example, the calibration execution unit 43 forms a coverage rate adjustment patch 22C, 22M, 22Y, 22K having a coverage rate corresponding to the difference between the coverage rate measured by the coverage rate measurement unit 42 and the coverage rate of the adjustment image pattern 21C, 21M, 21Y, 21K (i.e. the ratio of the number of pixels of the adjustment image pattern 21*i* (i=C, Y, Y, K) of each toner color to the number of pixels of the predetermined drawing area in calibration) together with the adjustment image pattern 21C, 21M, 21Y, 21K (in the drawing area) using the exposure device 2 and the developing device 3*a* to 3*d* in calibration.

The drawing area is, for example, a range in the sub-scanning direction from the front end of the first adjustment image pattern 21C, 21M, 21Y, 21K to the rear end of the last adjustment image pattern 21C, 21M, 21Y, 21K. Further, the range of the drawing area in the main scanning direction is from the left end of the left adjustment image pattern 21C, 21M, 21Y, 21K to the right end of the right adjustment image pattern 21C, 21M, 21Y, 21K.

In this embodiment, the calibration execution unit 43 forms a coverage rate adjustment patch 22C, 22M, 22Y, 22K having a coverage rate corresponding to the difference between the coverage rate of the print image of one page immediately before calibration measured by the coverage rate measurement unit 42 and the coverage rate of the adjustment image pattern 21C, 21M, 21Y, 21K together with the adjustment image pattern 21C, 21M, 21Y, 21K using the exposure device 2 and the developing device 3*a* to 3*d* in calibration.

For example, as shown in FIG. 3, the adjustment image pattern 21C, 21M, 21Y, 21K is fixed (i.e. has a fixed color, shape, and density) regardless of the coverage rate measured by the coverage rate measurement unit 42, and the coverage rate adjustment patch 22C, 22M, 22Y, 22K is formed independently of (i.e. separated from) the adjustment image pattern 21C, 21M, 21Y, 21K and in parallel with the adjustment image pattern 21C, 21M, 21Y, 21K along the sub-scanning direction (the movement direction of the intermediate transfer belt 5). That is, the adjustment image pattern 21C, 21M, 21Y, 21K is disposed so as to pass through the measurement region of the density sensor 8 in the main scanning direction (that is, the width direction of the intermediate transfer belt 5), and the coverage rate adjustment patch 22C, 22M, 22Y, 22K is disposed so as not to pass through the measurement region of the density sensor 8.

FIG. 4 is a diagram showing an example of a coverage rate of the coverage rate adjustment patch 22C, 22M, 22Y, 22K in FIG. 3. In the case shown in FIG. 4, the coverage rate of each adjustment image pattern 21C, 21M, 21Y, 21K is 1%.

Further, in this embodiment, for example, as shown in FIG. 4, the calibration execution unit 43 forms the coverage rate adjustment patch 22C, 22M, 22Y, 22K having a coverage rate corresponding to the difference together with the adjustment image pattern 21C, 21M, 21Y, 21K when the difference is a positive value, and forms the adjustment image pattern 21C, 21M, 21Y, 21K without forming the coverage rate adjustment patch 22C, 22M, 22Y, 22K in calibration when the difference is 0 or a negative value.

In Example 1 shown in FIG. 4, the coverage rates of the cyan, magenta, yellow, and black coverage rate adjustment patches 22C, 22M, 22Y, 22K are values obtained by subtracting 1% from the coverage rates measured for cyan, magenta, yellow, and black, respectively.

In Example 2 shown in FIG. 4, the coverage rates of the cyan, magenta, and black coverage rate adjustment patch 22C, 22M, 22K are values obtained by subtracting 1% from the coverage rates measured for cyan, magenta, and black, respectively, and the coverage rate of the yellow coverage rate adjustment patch 22Y is 0 because the value obtained by subtracting 1% from the coverage rate measured for yellow is a negative value. In Example 2, since the coverage rates of the magenta and yellow coverage rate adjustment patches 22M, 22Y are 0, the magenta and yellow coverage rate adjustment patches 22M, 22Y are not formed in the calibration.

Next, the operation of the image forming apparatus will be described.

The control unit 41 performs predetermined image processing on the target image in accordance with a user operation or the like, controls the photosensitive drum 1*a* to 1*d*, the exposure device 2, the developing device 3*a* to 3*d*, and the like, and executes printing of the target image after the image processing. The coverage rate measurement unit 42 measures a coverage rate of a print image of the print executed by the control unit 41 for each page (for each sheet), and stores a measurement value of the coverage rate in a storage device (a nonvolatile memory or the like) which is not illustrated.

When a calibration executing timing has arrived, in the calibration, the calibration execution unit 43 first calculates the coverage rates of the cyan, magenta, yellow, and black coverage rate adjustment patch 22C, 22M, 22Y, 22K based on the coverage rate measurement values (here, immediately preceding measurement values) of cyan, magenta, yellow, and black and the coverage rate (constant) of the adjustment image pattern 21C, 21M, 21Y, 21K as described above, and derives an image of the coverage rate adjustment patch 22C, 22M, 22Y, 22K having a shape and/or density corresponding to the calculated coverage rates.

For example, a reserved region for a coverage rate adjustment patch 22C, 22M, 22Y, 22K corresponding to an upper limit coverage rate (for example, 25%) is set in advance. Each of the coverage rate adjustment patches 22C, 22M, 22Y, 22K has a rectangular shape, the width (length in the main scanning direction) and/or the length (length in the sub-scanning direction) thereof is determined in accordance with the calculated coverage rate, and a coverage rate adjustment patch 22C, 22M, 22Y, 22K having the determined shape is formed in the reserved region.

Next, the calibration execution unit 43 uses the exposure device 2 and the developing device 3*a* to 3*d* to form the coverage rate adjustment patch 22C, 22M, 22Y, 22K together with the adjustment image pattern 21C, 21M, 21Y, 21K on the photosensitive drum 1*a* to 1*d*, transfers the adjustment image pattern 21C, 21M, 21Y, 21K and the coverage rate adjustment patch 22C, 22M, 22Y, 22K to the intermediate transfer belt 5 by the primary transfer roller 9*a* to 9*d*, and measures the density of the adjustment image pattern 21C, 21M, 21Y, 21K on the intermediate transfer belt 5 by the density sensor 8.

Thereafter, the adjustment image pattern 21C, 21M, 21Y, 21K and the coverage rate adjustment patch 22C, 22M, 22Y, 22K are removed from the intermediate transfer belt 5 by a cleaning device (not shown) without being secondarily transferred.

Then, the calibration execution unit 43 adjusts the image density characteristics based on the measured density of the adjustment image pattern 21C, 21M, 21Y, 21K. In the calibration, measurement of the toner charge amount is not performed.

As described above, according to the above-described embodiment, the coverage rate measurement unit 42 measures the coverage rate of a print image, and the calibration execution unit 43 forms an adjustment image pattern using the exposure device 2 and the developing device 3*a* to 3*d*, measures the density of the adjustment image pattern using the density sensor 8, and executes image density adjustment based on the measured density, in calibration. Then, the calibration execution unit 43 forms a coverage rate adjustment patch having a coverage rate corresponding to a difference between the coverage rate measured by the coverage rate measurement unit 42 and the coverage rate of the adjustment image pattern together with the adjustment image pattern using the exposure device 2 and the developing device 3*a* to 3*d* in calibration.

As a result, since the coverage rate of the image developed at the time of calibration approaches the coverage rate measured before, the fluctuation of the toner charge amount during calibration is suppressed, and the image density adjustment in calibration is accurately performed. Further, since the fluctuation of the toner charge amount immediately after the calibration is suppressed, the image density characteristic of the first print image after the calibration is also improved.

Various changes and modifications to the above-described embodiments will be apparent to those skilled in the art. Such changes and modifications may be made without departing from the spirit and scope of the subject matter and without diminishing its intended advantages. It is therefore intended that such changes and modifications be included within the scope of the appended claims.

For example, the image forming apparatus according to the above-described embodiment is a color image forming apparatus, but may be a monochrome image forming apparatus having one color plane (only black).

What is claimed is:

1. An image forming apparatus comprising:

a photosensitive drum;

an exposure device that irradiates the photosensitive drum with light to form an electrostatic latent image;

a developing device that performs development by causing toner to adhere to the electrostatic latent image;

a calibration execution unit that forms an adjustment image pattern by using the exposure device and the developing device, measures a density of the adjustment image pattern by using an optical sensor, and executes image density adjustment based on the measured density, in calibration; and a coverage rate measurement unit that measures coverage rate of a print image, wherein the calibration execution unit forms a coverage rate adjustment patch having a coverage rate corresponding to a difference between the coverage rate measured by the coverage rate measurement unit and a coverage rate of the adjustment image pattern together with the adjustment image pattern by using the exposure device and the developing device in the calibration.

2. The image forming apparatus according to claim 1, wherein the calibration execution unit forms a coverage rate adjustment patch having a coverage rate corresponding to a difference between a coverage rate of a print image of one page immediately before calibration measured by the coverage rate measurement unit and the coverage rate of the adjustment image pattern together with the adjustment image pattern using the exposure device and the developing device in the calibration.

3. The image forming apparatus according to claim 1, wherein when the difference is a positive value, the calibration execution unit forms the coverage rate adjustment patch in which the difference becomes a coverage rate together with the adjustment image pattern, and when the difference is 0 or a negative value, the calibration execution unit forms the adjustment image pattern without forming the coverage rate adjustment patch in the calibration.

4. The image forming apparatus according to claim 1, wherein the adjustment image pattern is fixed regardless of the coverage rate measured by the coverage rate measurement unit, and the coverage rate adjustment patch is formed independently of the adjustment image pattern.

* * * * *